United States Patent [19]

Hausmann

[11] Patent Number: 4,958,063

[45] Date of Patent: Sep. 18, 1990

[54] DEVICE FOR COUNTING OBJECTS

[75] Inventor: Peter Hausmann, Bäretswil, Switzerland

[73] Assignee: Ferag AG, Hinwil, Switzerland

[21] Appl. No.: 371,393

[22] Filed: Jun. 26, 1989

[30] Foreign Application Priority Data

Jun. 29, 1988 [CH] Switzerland ..... 02476/88

[51] Int. Cl.[5] ..... G06M 1/12

[52] U.S. Cl. ..... 235/201 FS; 235/98 R; 235/200 R

[58] Field of Search ..... 235/98 R, 98 A, 98 C, 235/200 R, 201 R, 201 ME, 201 FS

[56] References Cited

U.S. PATENT DOCUMENTS

| | | | |
|---|---|---|---|
| 3,366,043 | 1/1968 | Fitch | 235/201 FS |
| 3,405,254 | 10/1968 | Dannatt | 235/201 FS X |
| 3,746,841 | 7/1973 | Fenske | 235/98 R X |
| 3,914,754 | 10/1975 | Kirk | 235/201 FS X |
| 4,387,295 | 6/1983 | Minichiello | 235/201 R |

FOREIGN PATENT DOCUMENTS

| | | |
|---|---|---|
| 0249871 | 12/1987 | European Pat. Off. . |
| 2385156 | 10/1978 | France . |

OTHER PUBLICATIONS

L. A. Salmanson; Aerodynamic Method for the Measurement of Input Parameters of Automatic Systems, Measuring Elements in the Field of Pneumatics, (1973).

*Primary Examiner*—Benjamin R. Fuller

*Attorney, Agent, or Firm*—Bell, Seltzer, Park & Gibson

[57] ABSTRACT

A ring-jet sensor (24) which is operated with air and is connected to an air-carrying line (23) is directed at the objects (27). The ring-jet sensor (24) is also coupled to a pressure sensor (37), the signal of which passes to a counter (40). In order to avoid connecting two lines to the ring-jet sensor (24), the said ring-jet sensor and also the pressure sensor (37), are each connected, in parallel, to one branch line (23, 35). The branch lines (23, 35) can carry either compressed air or suction air.

7 Claims, 3 Drawing Sheets

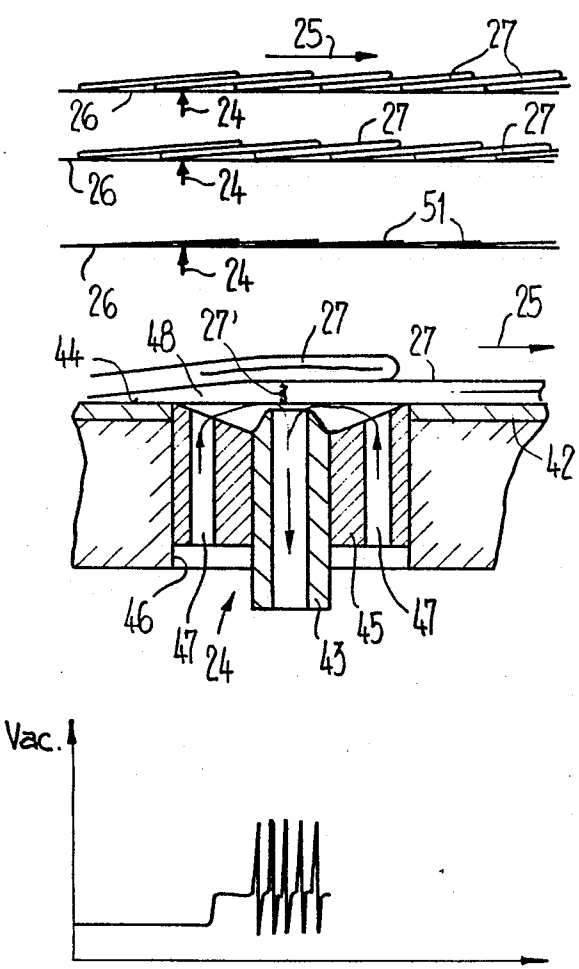
Fig. 8a
Fig. 8b
Fig. 8c
Fig. 4
Fig. 6
Vac.
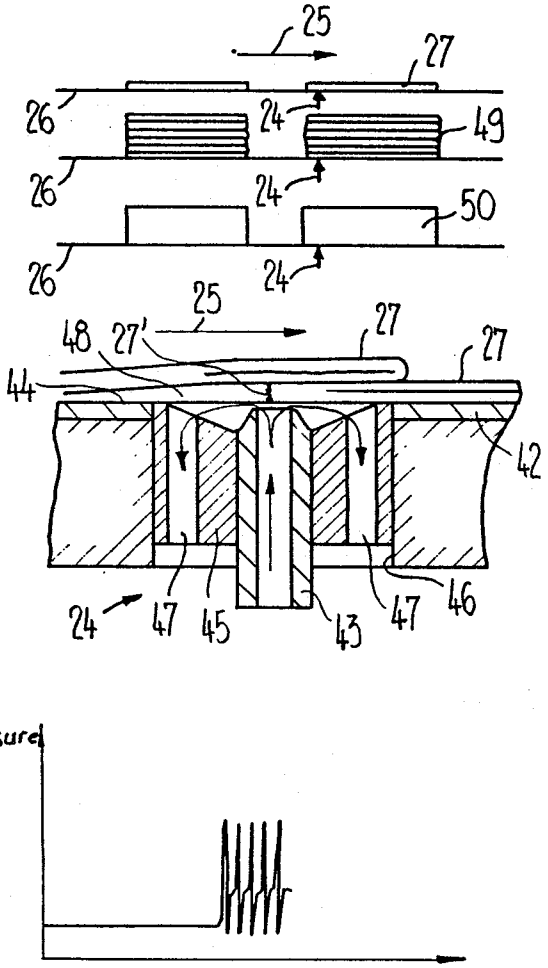
Fig. 7a
Fig. 7b
Fig. 7c
Fig. 3
Fig. 5
Pressure

DEVICE FOR COUNTING OBJECTS

FIELD OF THE INVENTION

The present invention relates to devices for counting objects and more particularly to counting objects being transported on a conveying device.

BACKGROUND OF THE INVENTION

Ring-jet sensors (also called reflex eyes) as signal generators in devices of this kind have the advantage that a heavy incidence of dirt, sources of noise, the risk of explosion, complete darkness, transparency or magnetic properties of the objects have no disturbing influence on their ability to function. They are also capable of emitting useful counting signals without a direct contact taking place between the ring-jet sensor and the object. Apart from the nozzle-like outlet of the ring-jet sensors, said sensors have, in the known devices of the type mentioned at the outset, two connections, namely one (often designated P) for the air supplied and one (often designated A) as signal connection for the pressure signal to be evaluated.

The requirement up to now that ring-jet sensors be provided with two connecting lines is a disadvantage which the invention aims to eliminate Accordingly, it is an object of the invention to provide a ring-jet sensor in a device using a single connecting line to the sensor.

SUMMARY OF THE INVENTION

It has surprisingly been found that the pressure conditions in the line leading to the ring-jet sensor undergo changes according to whether an object is present in the region of the nozzle-like outlet of this sensor, which changes can be directly evaluated, with the result that a separate line connected to the signal connection and leading to the pressure sensor is not required. Accordingly, the objects of the present invention are accomplished by a device comprising a ring-jet sensor directed at the objects on a conveying device and operated with air. A line is coupled to the ring-jet sensor in fluid communication and a pressure sensor unit including a counter is connected to the line for sensing pressure changes in the line indicative of an object to be counted. The ring-jet sensor and the pressure sensor unit are each connected to only one branch of the line.

BRIEF DESCRIPTION OF THE DRAWINGS

The invention is described in greater detail below, purely by way of example, with reference to the drawing, in which—

FIG. 3 is a cross sectional view of a ring-jet sensor operating with compressed air;

FIG. 4 is a cross sectional view of the ring-jet sensor similar to FIG. 3, operating with suction air;

FIG. 5 is a graph illustrating changes occurring in the line when the ring-jet sensor is operated in accordance with FIG. 3;

FIG. 6 is a graph illustrating the pressure changes occurring in the line when the ring-jet sensor is operated in accordance with FIG. 4;

FIG. 7*a* is a side elevational view of a conveyor illustrating an example of the form in which objects may be counted;

FIG. 7*b* is a side elevational view similar to FIG. 7*a* illustrating a second example of the form in which objects may be counted;

FIG. 7*c* is a side elevational view similar to FIG. 7*a* illustrating a third example of the form in which objects may be counted;

FIG. 8*a* is a side elevational view similar to FIG. 7*a* illustrating a fourth example of the form in which objects may be counted;

FIG. 8*b* is a side elevational view similar to FIG. 7*a* illustrating a fifth example of the form in which objects may be counted; and FIG. 8*c* is a side elevational view similar to FIG. 7*a* illustrating a sixth example of the form in which objects may be counted;

DETAILED DESCRIPTION OF THE PREFERRED EMBODIMENT

Figure 1:
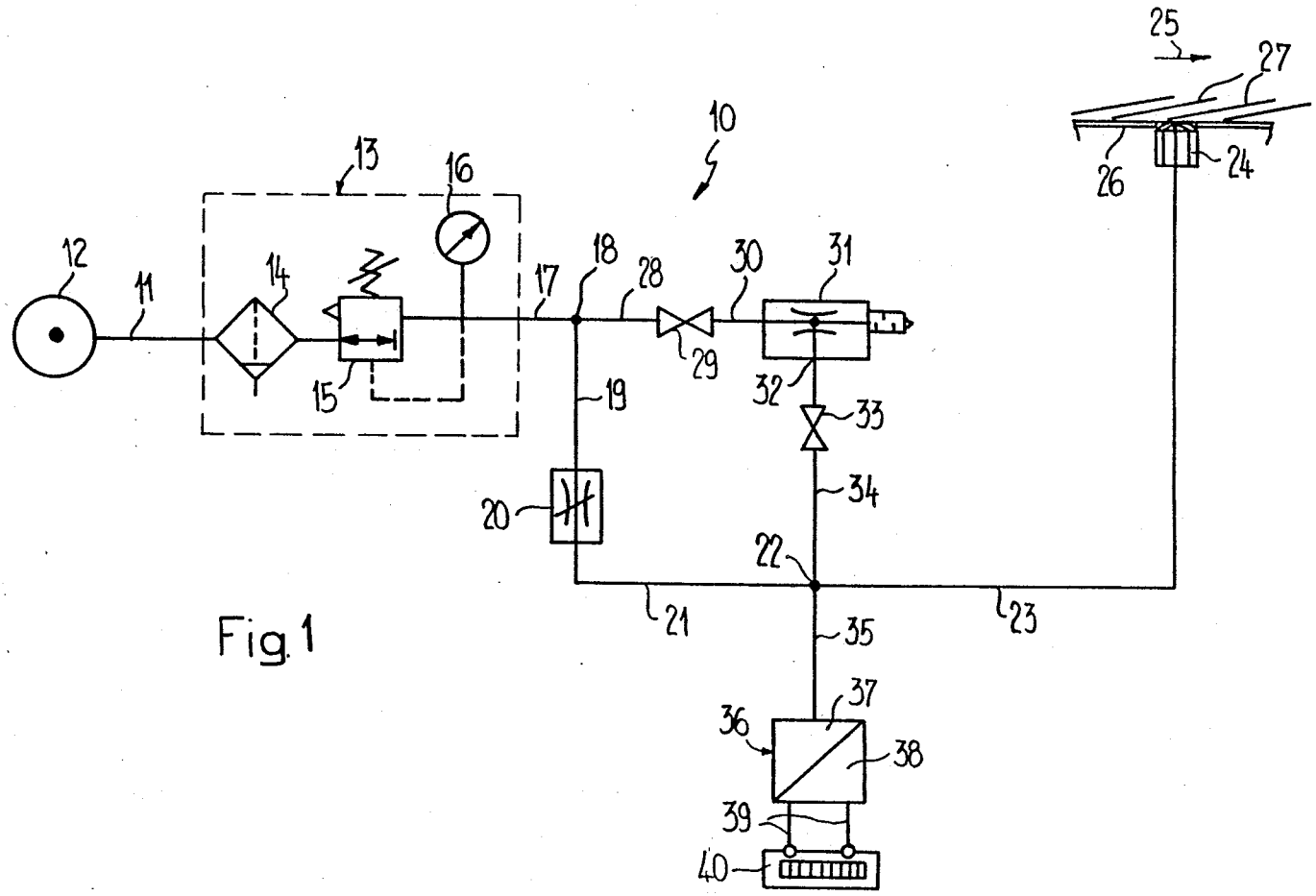
FIG. 1 is a schematic diagram of a device for counting objects embodying the features of the present invention.

The device 10 represented in FIG. 1 is connected to a conventional compressed air system 12 via a line 11. The line 11 leads to a treatment unit 13, which renders the air drawn from the system 12 suitable for the device in terms of purity and pressure. In the example illustrated, the unit 13 has a demister 14, a valve 15, for example a pressure throttle valve, as well as a manometer 16. The outlet of the unit 13, said outlet being designated 17, leads to a branch 18. A line 19 leads from the branch 18 to a controllable and closeable throttle valve 20. From the throttle valve 20, a line 21 leads to a ring-jet sensor 24. The ring-jet sensor 24 is associated with a conveyor belt device 26 running in direction 25, on which the objects, in this case newspapers 27, are transported in an overlapping formation.

From the branch 18, a further line 28 leads to a shut-off valve 29, the outlet 30 of which is connected to an air ejector pump 31. The suction side 32 of the ejector pump 31, which may alternatively be a suction pump, leads to intersection 22 via a further shut-off valve 33 and a line 34.

Finally, from the point of intersection 22 a further branch line 35 leads to a transducer unit which has at least one pressure sensor 37 and an amplifier 38, the outputs 39 of which are finally connected to a counter 40.

Accordingly, the device 10, through the manipulations of the valves 20, 29 and 33 may operate using compressed air or vacuum pressure.

Figure 2:
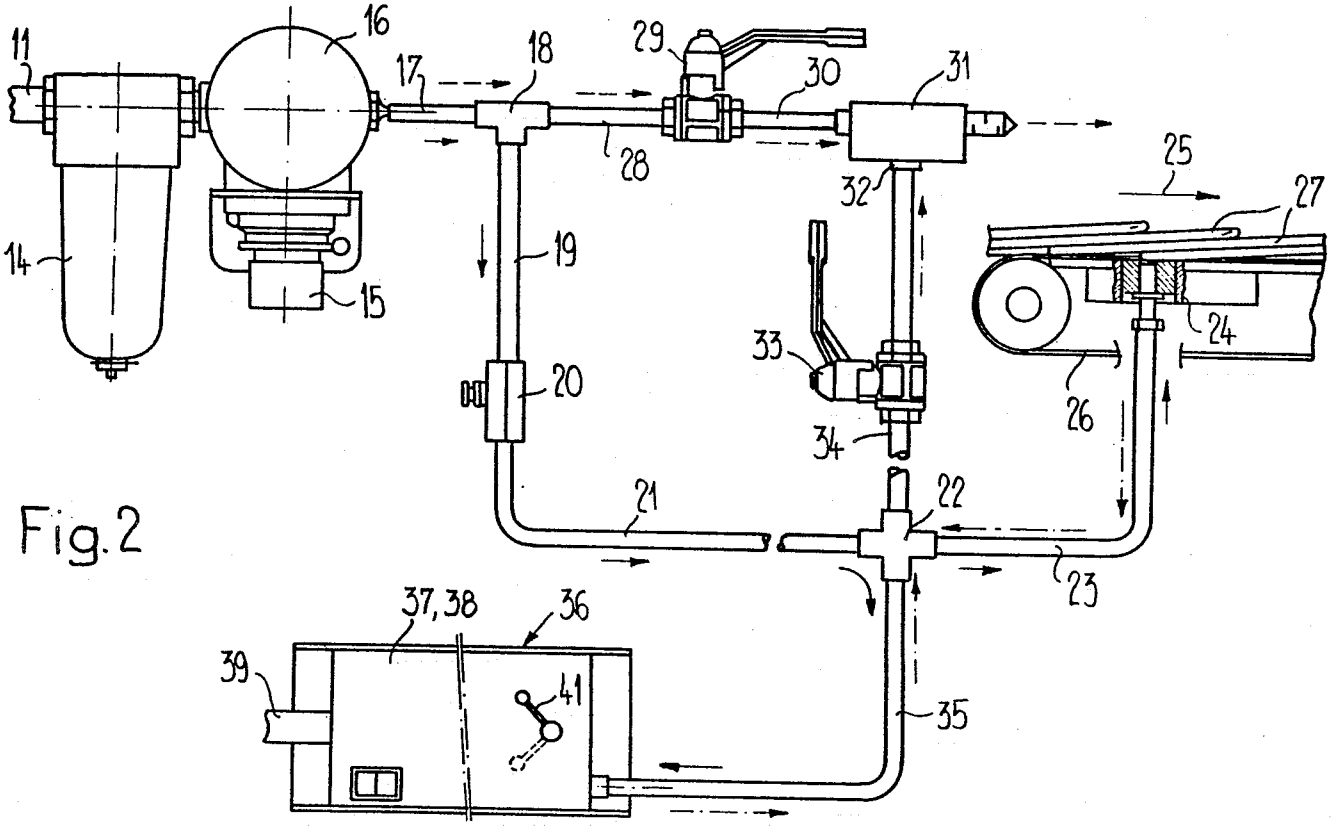
FIG. 2 is a fragmentary generally schematic view of a practical embodiment of the device.

The mode of operation of the device represented FIG. 1 will now be explained with reference to FIG. 2, in which the individual components are designated by the same reference numerals as in FIG. 1.

If the ring-jet sensor 24 is to be operated with compressed air, the shut-off valves 29 and 33 are to be closed and the throttle valve 20 opened until a pressure of about 0.1–0.3 bar is present in the line 21. The flow conditions created are represented by unbroken arrows in FIG. 2.

If, on the other hand, the ring-jet sensor 24 is to be operated with suction air, the shut-off valves 29 and 33 are to be opened and the throttle valve 20 closed. The flow conditions which arise are drawn in with dashed arrows in so far as the compressed air is concerned and with chain-dotted arrows in so far as the suction air is concerned.

It should be noted that if the pressure sensor(s) present in the transducer unit 36 are back-pressure sensors, no flow occurs in the branch line 35, only a changing static pressure. In this case, the arrows associated in FIG. 2 with the branch line 35 merely indicate the mode of operation of the ring-jet sensor 24. If the transducer unit 36 is provided with each a pressure sensor responding to positive pressure and a pressure sensor responding to negative pressure, the branch line 35 is to be connected by means of a changeover valve 41 so as to switch between the pressure sensors.

The nozzle-like outlet to the ring-jet sensor 24 on the one hand and its mode of action on the other hand when operated with compressed air and when operated with suction air will now be described with reference to FIGS. 3 and 4.

The conveyor belt device 26 has two conveyor belts running next to one another at a distance in the direction of the arrow 25. Between these conveyor belts is arranged a sliding table 42 into which the ring-jet sensor 24 is set. The sensor 24 has a central tube 43 which is connected to the branch line 23. That end of the tube 43 which appears at the top in FIGS. 3 and 4 is tapered and ends at a very short distance (for example 1–4 mm) below the surface 44 of the sliding table 42. The tube 43 is held in a mounting 45 which is secured in a through bore 46 in the sliding table 42. In the mounting 45 there is a set of passages 47 surrounding the tube 43. The passages 47 lead into the surrounding environment.

Referring now to FIG. 3, compressed air is fed to the ring-jet sensor 24 via the tube 43. At the moment when the trailing edge 27' of a newspaper or other object is transported over the upper end of the tube 43 (as represented in FIG. 3), the free escape of the compressed air upwards is inhibited and, as indicated by arrows, the latter must escape through the passages 47. As a consequence there is a momentary pressure rise in the tube 43 and hence the branch line 23 and also in the branch line 35, which is detected by the pressure sensor 37. However, as soon as the trailing edge 27' has left the upper opening of the tube 43 and the gap 48, following the trailing edge 27', between the surface 44 of the sliding table 42 and the following newspaper 27 reaches the upper end of the tube 43, the compressed air supplied has less resistance to overcome in order to escape. The "back pressure" in the tube 43 and in the branch lines 23, 35 decreases, this being detected by the pressure sensor 37. In FIG. 5, the jumps or pressure changes in the branch line 35 are plotted against time.

In FIG. 4, the tube 43 carries suction air, i.e. the throttle valve 20 is closed and the shut-off valves 29, 33 are open. Consequently, air is drawn in through the tube 43 from the surrounding environment. If, as illustrated, an overlapping stream of newspapers is passing over the ring-jet sensor 24, the supply of air to the upper end of the tube 43 is somewhat inhibited. When, in addition the trailing edge 27' passes over, which is here formed by a cut edge (the so-called "bloom") of the newspaper 27, the tube 43 draws the lowermost sheet of the newspaper to its end in the region of the trailing edge 27'. The consequence of this is that the reduced pressure in the tube 43 and hence in the line 43 and in the branch line 35 is momentarily greater and this is detected by the pressure sensor 37. As soon as the trailing edge 27' leaves the opening of the tube 43, more air can flow via the passages 47 and the gap 48 with less inhibition, with the result that the reduced pressure in 34 and in 35 is once more stabilized at its normal value. The fluctuations in the reduced pressure are plotted in graph form over time, the origin of the ordinate axis designated Vac signifying vacuum below ambient pressure.

Now that the counting of newspapers in an overlapping stream has been described, FIGS. *7a*, *7b*, and *7c* show that the device can also be used to count objects which are transported at a distance from one another. In FIGS. 7 and 8, the location of the ring-jet sensor 24 is indicated by an upward-pointing arrow.

In FIG. *7a*, individual copies of the newspaper are being counted. In FIG. *7b*, stacks 49 and in FIG. *7c* by way of example, cartons or boxes 50 are counted.

In FIGS. 8*a* and 8*b*, it can be discerned that the device 10 is not only suitable for the conventional formation of the overlapping stream (the fold being the leading edge and overlapping or overlapped) but also for an overlapping stream in which the fold trails. In FIG. 8*c* individual sheets 51 are to be counted in which there is the risk that if the ring-jet sensor 24 is operated with compressed air, the individual sheets 51 will be blown away, resulting in an unreliable count. If, on the other hand, the sensor 24 is operated with suction air, a satisfactory count results since the upper end of the tube 43 is only "blocked" when a free edge of the individual sheet passes.

Thus, in the case of the device described, the pressure sensor is not connected to the signal output of the ring-jet sensor, i.e. in series with the latter, but in parallel with it, thereby simplifying the proposed device. In operation with suction air, the risk arises of drawing in dirt, however, it is possible to install a conventional dirt separator in the line 34 to ensure that the satisfactory functioning of the suction pump 31 remains guaranteed.

In the drawings and specification, there has been set forth preferred embodiments of the invention, and although specific terms are employed, they are used in a generic and descriptive sense only and not for purposes of limitation.

That which is claimed is:

1. An apparatus for counting articles being conveyed along a path of travel, and comprising air delivery line means (21,34), means for delivering air through said air delivery line means, a ring-jet sensor (24) mounted adjacent said path of travel and having an outlet directed toward the conveyed articles, and with said sensor being coupled to a first branch line (23), pressure sensor means (36) coupled to a second branch line (35) for sensing and counting pressure changes in said second branch line, and with said first and second branch lines being coupled in parallel to said air delivery line means, and whereby pressure changes are induced in said air delivery line means by an article being conveyed past said ring-jet sensor and such pressure changes are adapted to be sensed and counted by said pressure sensor means.

2. The apparatus as defined in claim 1 wherein said means for delivery air through said air delivery line means comprises means for selectively deliverying either suctioned air or pressurized air through said air delivery line means.

3. The apparatus as defined in claim 1 wherein said air delivery line means comprises a first air delivery line (21) and a second air delivery line (34) coupled at an interconnection (22).

4. The apparatus as defined in claim 3 wherein said means for delivering air through said air delivery line means comprises means for selectively delivery pressurized air through said first air delivery line or drawing suctioned air through said second air delivery line.

5. The apparatus as defined in claim 1 wherein said pressure sensor means comprises a first pressure sensor which is responsive to positive pressure, a second pressure sensor which is responsive to negative pressure, and changeover valve means (41) for selectively connecting either one of said first and second pressure sensors to said second branch line.

6. The apparatus as defined in claim 1 wherein said pressure sensor means comprises means responsive to a differential pressure.

7. An apparatus for counting articles being conveyed along a path of travel, and comprising air delivery line means including a first air delivery line (21), and a second air delivery line (34), with said first and second lines being coupled together at an interconnection (22), means for selectively delivering pressurized air through said first air delivery line, or drawing suctioned air through said second air delivery line, a ring-jet sensor (24) mounted adjacent said path of travel and having an outlet directed toward the conveyed articles, and with said sensor being coupled to a first branch line (23), pressure sensor means (36) coupled to a second branch line (35) for sensing and counting pressure changes in said second branch line, and with said first and second branch lines being coupled in parallel to said air delivery line means at said interconnection, and whereby pressure changes are induced in said air delivery line means by an article being conveyed past said ring-jet sensor and such pressure changes are adapted to be sensed and counted by said pressure sensor means.

* * * * *